United States Patent [19]

Silver

[11] 4,287,618

[45] Sep. 8, 1981

[54] PORTABLE THERAPEUTIC SITZ-BATH, SHOWER AND BIDET COMBINATION

[76] Inventor: Louis Silver, 5825 Collins Ave., Apt. 15B, Miami Beach, Fla. 33139

[21] Appl. No.: 33,456

[22] Filed: Apr. 26, 1979

[51] Int. Cl.[3] ..... A47K 7/08; A47K 3/12

[52] U.S. Cl. ..... 4/443; 4/420.2; 4/420.3; 4/444; 4/448; 128/375

[58] Field of Search ..... 128/366, 369, 371, 375; 4/145, 146, 6, 7, 185 R, 185 AB, 185 S, 420.2–420.4, 443–448, 450, 479, 515, 518, 567, 571, 578, 579, 590, 596, 597, 611, 615, 639, 641, 191

[56] References Cited

U.S. PATENT DOCUMENTS

| | | | |
|---|---|---|---|
| 1,988,737 | 1/1935 | Jauregui | 4/7 |
| 2,075,061 | 3/1937 | Salvoni | 4/7 |
| 2,112,662 | 3/1938 | Bentz | 4/185 S |
| 2,139,951 | 12/1938 | Gaston et al. | 4/6 |
| 2,427,807 | 9/1947 | Oliver | 4/6 |
| 3,288,140 | 11/1966 | McCarthy | 4/6 X |
| 3,528,112 | 9/1970 | Warnick | 4/185 R |
| 3,577,567 | 5/1971 | Wintercorn | 4/7 |
| 3,654,636 | 4/1972 | Restyanszki | 4/6 X |
| 3,812,543 | 5/1974 | Stinson | 4/6 X |
| 3,902,200 | 9/1975 | Pratt | 4/6 |
| 3,947,898 | 4/1976 | Ducharme | 4/6 |
| 3,995,326 | 12/1976 | Umann | 4/7 |
| 4,069,520 | 1/1978 | Thomas | 4/7 |

*Primary Examiner*—Stuart S. Levy
*Attorney, Agent, or Firm*—Ronald E. Smith

[57] ABSTRACT

A combination sitz bath, sitz shower, bidet and warm air unit. A portable unit comprises a U-shaped toilet seat supported at a sitting height by a hollow rigid construction having an open bottom. Adjustably positioned below said seat is a shower head aligned to direct water discharging therefrom in a vertical direction. A basin fits snugly around said showerhead to optionally provide a sitz bath. Additionally, bidet means are connected between an external water source and said shower head, and an adjustably positionable warm air unit provides a drying function.

4 Claims, 4 Drawing Figures

PORTABLE THERAPEUTIC SITZ-BATH, SHOWER AND BIDET COMBINATION

BACKGROUND OF THE INVENTION

1. Field of the Invention

This invention is generally related to therapeutic devices usuable by individuals suffering from hemorrhoids, fissures or other ailments of the peri-anal area, and more specifically relates to a device which provides a sitz shower, a sitz bath, a bidet, and a warm air unit in one portable therapeutic device.

2. Description of the Prior Art

A search of the patent literature discovered the following U.S. Pat. Nos.: 1,988,737 (1935); 3,577,567 (1971); and 2,075,061 (1937).

The earlier devices suffer from a common limitation in that each of them requires attachment to a existing, permanently mounted, toilet facility.

SUMMARY OF THE INVENTION

A shower head is connected to a source of water under pressure by suitable flexible piping means. A plurality of valves is provided at the point of connection of said piping means and said shower head. The first valve diverts the flow of water from the shower head to a discharge opening so that the user of the inventive device may test the temperature of the water prior to taking the sitting position on a toilet-type seat positioned upwardly of said shower head. A second valve controls the pressure of water entering either a bidet or the shower head. A third valve diverts the flow of water otherwise destined for the shower head to the hand held bidet member. A container is fitted about the shower head in water type relationship to collect water discharging from the head into a basin defined by the container for further providing a sitz bath. Means are also provided for adjusting the height of the shower head and the warm air unit provided for drying purposes.

It is therefore an object of the invention to provide a multi-purpose therapeutic device that is portable and does not require expensive plumbing mechanisms for its installation.

It is a further object to provide a therapeutic device that provides stimulating water massage, increasing blood circulation in the affected area of a hemorrhoid sufferer, thus relieving pain and itching and aiding in reducing swelling of the hemorrhoidal tissue.

Still another object is to provide post-operative patients with gentle streams of temperature controlled water to cleans the anal area after bodily functions are performed.

Still another function is to provide a hot air dryer that not only dries the anal area but further provides heat therapy.

BRIEF DESCRIPTION OF THE DRAWINGS

Further objects and advantages of the present invention will become apparent as the following description proceeds, taken in conjunction with the accompanying drawings in which.

DETAILED DESCRIPTION OF THE PREFERRED EMBODIMENT

Figure 1:
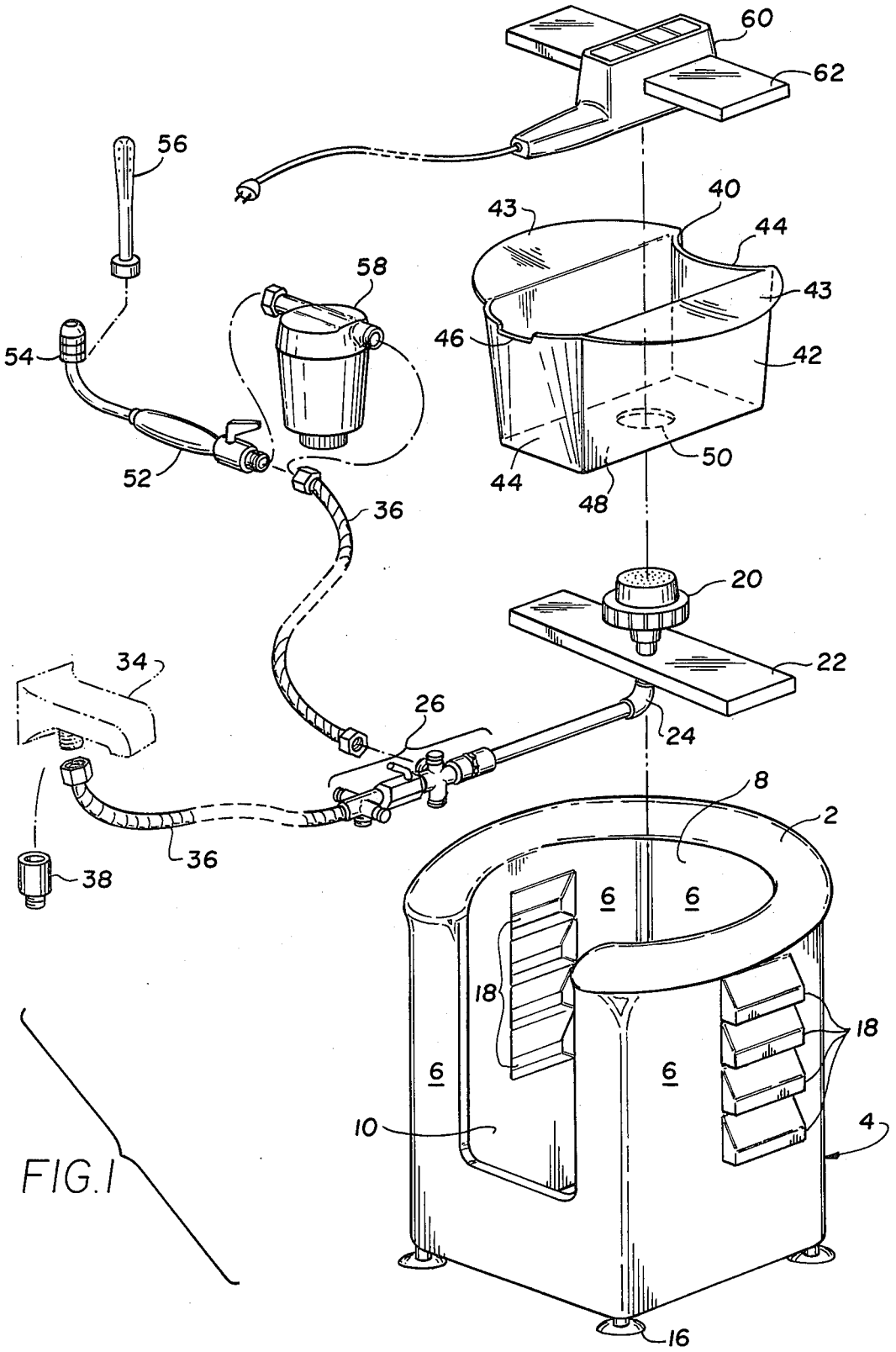
FIG. 1 is a perspective, exploded view of the preferred embodiment.

The preferred embodiment, shown for illustrative purposes only, includes a generally U-shaped toilet-type seat 2, best seen in FIG. 1. The seat 2 is supported at a comfortable sitting height above a support surface, not shown, by an integrally formed support structure, or base 4. The base 4 comprises a plurality of integrally formed side walls 6 defining a cavity 8 therebetween. The base 4 is of open-bottom and open-top construction. The side wall 6 associated with the open portion of the U-shaped seat 2 has an elongate, generally rectangular access opening 10 formed therein, in communication with said open portion.

The base is preferably of rigid material capable of supporting persons weighing over 300 pounds.

The base 4 is preferably provided with a plurality of suction cups 16 conventionally mounted at the lower corners of the base 4 for establishing non-slip engagement between the base 4 and the support surface, not shown.

The construction of the preferred base 4 is concluded by providing a plurality of opposed recesses 18 in the side walls 6 that are generally perpendicular to the side walls 6 having the access opening 10. Each recess 18 is horizontally aligned with an opposing associated recess 18. The recesses 18 may take many forms. A plurality of opposed, aligned projections could also serve the function of the recesses 18, for example.

Figure 2:
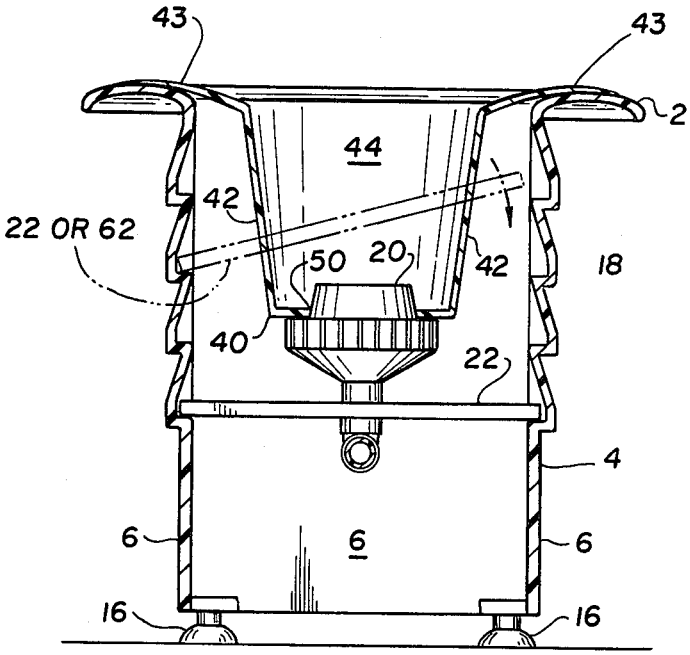
FIG. 2 is a cross-sectional view of FIG. 1.

The function of the recess is to provide vertically adjustable support means for a sprayhead 20, the neck of which protrudes upwardly through a centrally disposed opening in a sprayhead crossbar 22. The opposed ends of the crossbar 22 are positioned within preselected associated opposed coplanar recesses 18 when it is desired to mount the sprayhead 20 within the cavity 8 at the preselected level. FIG. 2 shows, in phantom lines, the manner in which the crossbar is inserted at the preselected level.

Figure 3:
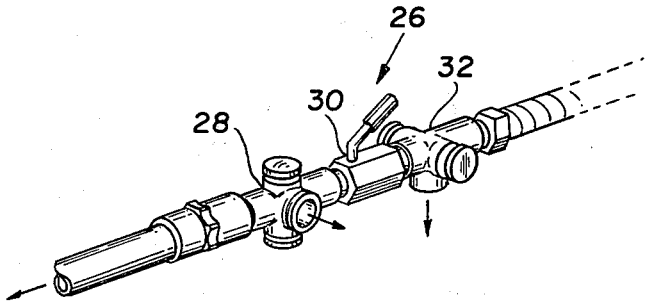
FIG. 3 is a detailed perspective view of the valve control system of the preferred embodiment.
Figure 4:
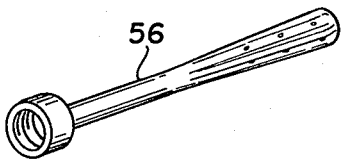
FIG. 4 is a detailed perspective view of the douche/enema fitting.

The neck of the sprayhead 20 is connected by means of an elbow joint 24 and flexible pipe means to a control unit 26, best seen in FIG. 3. The control unit 26 comprises a side outlet diverter valve 28, a flow control throttle valve 30, and a bottom outlet diverter valve 32. The valves 28, 30 and 32 are connected in series between the sprayhead 20 and the source of water under pressure 34 by a flexible armored hose 36 and a custom adapter 38, if needed.

A sitz basin, generally designated 40 and shown in perspective in FIG. 1, is fitted about the sprayhead 20 as shown in FIG. 2. The basin has a pair of elongate sidewalls 42 and a pair of curvilinear end walls 44. One of the end walls 44 is of concave configuration, and the other end wall 44 is of convex configuration. The end wall 44 of convex configuration has an over flow weir 46 at its upper edge. The bottom plate 48 of the basin has a centrally disposed aperture 50 formed therein, said aperture having a diameter only slightly greater than the spray head 20 so that a water tight fit is formed with the spray head 20 protrudes through said spray head receiving aperture 50. An annular gasket, not shown, provides a means by which such water tight fit can be achieved. The basin is further provided with flanges 43 adapted to overlie the seat 2.

Connected to the side outlet diverter valve 28 by another flexible armored hose 36 is a hand held bidet 52 having a spray fitting with an aerator 54 adapted to engage a douche/enema attachment 56. A feed unit 58 for introducing hygenic, aeromatic, or medicinal fluid into the water stream is further connected between the bidet 52 and the side outlet diverter valve 28.

An electrically operated warm air unit 60 mounted on a crossbar 62 completes the assembly of the preferred embodiment of the invention.

When a sufferer of peri-rectal disorders desires a sitz shower treatment, the seat 2 and base 4 unit is placed in a bathtub, shower stall, or other location having adequate draining facilities and resistance to water damage. The suction cups 16 are tested to insure that the unit is safely secured. The sprayhead crossbar 22 carrying the sprayhead 20 is then placed at the desired level into the cavity 8 by placement in the proper recesses 18. The water supply 34 is turned on, to a low pressure, and bottom outlet diverter valve 32 is activated so that the user may test the water temperature and adjust the same accordingly to his or her preference. Having made the temperature adjustment, the user takes the sitting position on the seat 2 and increases the pressure of water eminating from the supply 34. The flow may be throttled to the desired pressure by manipulation of throttle valve 30. The open bottom construction of the base permits continuous drainage of water from the base 4.

When the user of the inventive device desires a sitz bath treatment, the sitz basin 40 is positioned atop the sprayhead 20 by concentrically aligning the spray head receiving aperture 50 and the spray head 20 and snugly fitting the former in water-tight relationship about the latter. The basin 40 is filled and the user positions himself on the seat 2. If a static sitz bath is desired, the water supply 34 is turned off when the basin 40 is filled. If a dynamic bath is desired, the water supply 34 is left on, and the overflow from the basin 40 is handled by overflow weir 46 formed preferably on the convex side wall 44 of the basin 40.

The concave configuration of the other sidewall 44 allows male users of the invention desiring to treat the rectal area to a sitz bath while keeping the genitals dry.

When the user desires to use the bidet 52 the flow from the water supply is diverted thereto by side outlet diverter valve 28. The manner of use of the bidet and its attachments will be apparent to those skilled in the applicable art.

Since post-operative patients must often refrain from physically contacting the rectal area, a warm air unit 60 carried in a crossbar 62 is provided to dry the rectal area after the sitz bath or shower or bidet treatment. The plurality of recesses 18 provides a means by which the warm air 60 may be positioned as desired.

The flexibility of the armored hose 36, the adaptation of the sitz basin 40 having a weir 46 to the spray head 20, the cross bars for carrying the spray head 20 and the warm air unit 60, the multi-purpose control unit 26, and, indeed, the portability and hollow construction of the unit comprising the seat 2 and the base 4 itself, all interact to provide a compact, portable sitz shower, sitz bath (both static and dynamic), bidet means and dryer means, heretofore unknown and unavailable. All of the attachments may be stored within the cavity 8, thereby providing for the convenient storage of the inventive device. The unexpected result of the combination disclosed herein is the remarkable number of therapeutic services provided by the device, its portability, its compactness, its adjustability, its safety, and the ease with which it may be understood and used, and its flling of a long standing need for such a therapeutic device that is affordable by individuals and easy to manufacture.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A therapeutic device, comprising, a toilet-type seat, rigid means for supporting said seat at a comfortable sitting height upwardly of a support surface, said rigid support means comprising a hollow, open-topped support structure, a shower head interposed between said seat and said support surface and aligned to discharge water in a substantially vertical direction, means for bringing said shower head into fluid communication with a source of water under pressure, open-topped container means removably fitted about said shower head for collecting water flowing therefrom, said container means having flange means to overlie said toilet seat, whereby said container means, when filled with water, provides a static sitz bath, and, whereby said flange engages said toilet seat thereby providing additional support for said container means, a weir formed on the uppermost portion of said container means to allow overflow of water collected therein so that said water source may continually supply water to said basin thereby providing a dynamic sitz bath, said support means having an open bottom construction for allowing water discharging from said shower head to flow toward a drain, said support means having a non-slip interface with said support surface, whereby the user of said portable device safely employs the same in a bathtub or shower stall environment, valve means for diverting the flow of water from said shower head to a discharge spout so that the temperature of the water can be adjusted prior to use of said device, hand held bidet means connected between said water source and said shower head by flexible piping means, valve means for diverting the flow of water from said water supply to said bidet means, pressure control means between said water source and said shower head and said bidet means, whereby the pressure of water flowing into either said shower head or said bidet means is adjustable by the user as desired said rigid support means having columnar side walls collectively defining an enclosed area, said toilet-type seat having a generally U-shaped configuration, one of said sidewalls having an elongate generally U-shaped, in elevational view, cut out portion in registration with the open portion of said U-shaped toilet-type seat so that said cut out portion provides an access opening to facilitate assembly, dissembly, and adjustability of the device whereby a portable sitz shower is provided.

2. The device of claim 1, comprising, adjustable means for variably adjusting the spacing between said vertically aligned shower head and said toilet seat, the range of said variable adjustments including a level at which the upper plane of said removably fitted container means is substantially coplanar with the plane of said toilet seat, whereby said removably fitted container means may be adjusted in height so that a sitz bath is provided at such height.

3. The device of claim 2, comprising, said removably fitted container means having a plurality of side walls defining a cavity therebetween, one of said side walls having a generally convex horizontal cross-section, the wall opposing said convex horizontal cross-section wall having a generally concave horizontal cross-section.

4. The device of claim 3, comprising, said removably fitted container means having a bottom plate and side walls integrally formed projecting upwardly therefrom and defining a cavity therebetween, said bottom plate having an aperture formed substantially centrally thereof for receiving said shower head interiorly of said cavity, water-tight sealing means for preventing leakage of water from said cavity of said container means through said aperture, said sealing means having flexibility to permit the ready engagement and disengagement of said container means around said shower head.

* * * * *